US005131960A

United States Patent [19]

Kluge

[11] Patent Number: 5,131,960

[45] Date of Patent: Jul. 21, 1992

[54] HEAT TREATMENT PROCESS

[75] Inventor: Ehrhard Kluge, Neunkirchen, Fed. Rep. of Germany

[73] Assignee: Rexnord Kette GmbH & Co. KG, Betzdorf, Fed. Rep. of Germany

[21] Appl. No.: 582,501

[22] Filed: Sep. 13, 1990

[30] Foreign Application Priority Data

Oct. 28, 1989 [DE] Fed. Rep. of Germany ..... 3936072

[51] Int. Cl.[5] ..... C21D 6/00; C21D 8/00

[52] U.S. Cl. ..... 148/608; 148/610

[58] Field of Search ..... 148/325, 12 EA, 12 A, 148/12, 4, 135

[56] References Cited

U.S. PATENT DOCUMENTS 4,824,491 4/1989 Tanaka et al. ..... 148/12 EA

FOREIGN PATENT DOCUMENTS 0072355 6/1982 European Pat. Off. .
0273279 12/1987 European Pat. Off. .
2160440 12/1971 Fed. Rep. of Germany .
2923532 6/1979 Fed. Rep. of Germany .
3105891 2/1981 Fed. Rep. of Germany .
1555907 1/1968 France .

*Primary Examiner*—Deborah Yee
*Attorney, Agent, or Firm*—Akoo-Toren

[57] ABSTRACT

By solution-annealing and water-quenching of a hot-rolled ferritic chromium steel comprising 0.03 to 0.07% carbon, not more than 1% silicon, not more than 1% manganese, 13 to 18% chromium, not more than 2% nickel, balance iron and impurities arising from melting, a ferritic martensitic microstructure can be obtained to achieve high strength, hardness and toughness.

5 Claims, 1 Drawing Sheet

HEAT TREATMENT PROCESS

TECHNICAL FIELD OF THE INVENTION

The invention relates to a process for the heat treatment of a hot-rolled ferritic chromium steel.

BACKGROUND OF THE INVENTION AND PRIOR ART

Stainless ferritic chromium steels are used for many purposes as structural steels owing to their high resistance to corrosion, in particular by oxidising media, at high levels of strength and toughness and because they are cheaper than austenitic alloys. The resistance to corrosion depends on the chromium and carbon contents of the individual steel. While the resistance to corrosion improves with increasing chromium content the presence of carbon leads to the formation of chromium-rich carbides which precipitate at the grain boundaries and there lead to chromium depletion. This depletion in chromium is associated with impairment of the corrosion resistance in view of the aforementioned connection between the chromium content and corrosion resistance, and as a result the ferritic steels are more or less susceptible to intercrystalline corrosion, depending on the carbon content. To counteract this efforts are made to keep the carbon content in ferritic steels as small as possible, or at least to combine it stably with titanium. This, however, is associated with a considerable loss in toughness and resistance to corrosion and with the formation of titanium oxide, which impairs the surface quality, toughness and hot-workability.

Low carbon contents are, however, associated with the disadvantage that the transformability, which is dependent upon the carbon content, is lost, so that it is not possible to obtain a desirable balance of high strength and adequate ductility and toughness by mean of heat treatment. Therefore the room temperature strengths of non-transformable ferritic chromium steels only differ marginally.

To obtain higher strengths it is known from German patent 29 23 532 to first soft-anneal a stainless ferritic chromium steel after hot-rolling and then to cold work it with an 18 to 25% reduction. The annealing temperature is usually about 750° to 850° C., since higher annealing temperatures are associated with grain-coarsening, which results in loss of toughness and difficulties in cold working.

In addition the known process is both relatively costly in view of the need for soft-annealing and subsequent cold-rolling, and results in tensile strengths of only 750 to 800 N/mm$^2$ as well as a considerable loss of ductility owing to the relatively large amount of cold-working.

OBJECT OF THE INVENTION

It is therefore an object of the invention to obtain, by means of a heat treatment, high strength and hardness and high cold workability without loss in toughness in a hot-rolled stainless ferritic chromium steel.

SUMMARY OF THE INVENTION

The invention is based on the surprising discovery that even with a carbon content of up to 0.07% a ferritic chromium steel with 13 to 18% chromium is transformable, and therefore hardenable. According to the invention a hot-rolled steel consisting essentially of:

0.03 to 0.07% carbon
not more than 1% silicon
not more than 1% manganese
13 to 18% chromium
not more than 2% nickel
balance iron and impurities arising from melting, is solution-annealed and quenched to a ferritic-martensitic two-phase microstructure with, for example, 50% martensite. The quenched structure is characterised by a very small grain size which has a high tensile strength of at least 800 N/mm$^2$, for example, 900 N/mm$^2$, and at the same time a high ductility which is exhibited in particular when bending with a small bend radius to zero in the bending test. As a result the heat-treated steel according to the invention can be bent without cracking, which is of great importance in the manufacture of flat-top chains connected together by hinge pins. Of similar importance is the high Rockwell B hardness of about 105 to 107 in the quenched state, which is associated with a correspondingly low susceptibility to scratching or loss of surface quality.

The steel should contain at least 1.0% nickel, not more than 0.035% phosphorus and not more than 0.025% sulphur and, in view of the ferritic microstructure, not more than 0.03% nitrogen; it preferably contains not more than 0.06% carbon, at least 0.01% nitrogen and at least 0.025% carbon plus nitrogen. Higher nickel contents increase the proportion of austenite in the microstructure and result in difficulties when hot-rolling, in particular in the formation of cracks when coiling. The chromium content is preferably at least 16%.

In the process according to the invention the hot-rolled strip is preferably water-quenched after continuous annealing, for example at a temperature above 1050° C. This leads to a microstructure that is unusually uniform along the length of the strip with corresponding uniformly high tensile strength, yield strength and hardness and excellent surface quality. On further processing, in particular in the manufacture of flat-top chains, this leads to correspondingly uniform chain members regardless to whether they stem from the start, the middle or the end of the strip.

Depending on the annealing and quenching temperatures above approximately 1000° C. different hardnesses result; the macro- and micro-hardness both increase with increasing quenching temperature.

The heat treatment according to the invention makes cold-rolling to increase the strength unnecessary; however the heat treatment according to the invention can be followed by skin pass or finish rolling in one or two passes with a reduction in thickness of up to 10%, preferably 2 to 8%, in particular 6%, to provide a strip with extremely close thickness tolerance and greater surface smoothness, which in turn improves the resistance to corrosion and which is of great importance when using the steel heat-treated according to the invention for roller chains and flat-top chains. Flat-top chains have guides, usually dove-tail shaped, welded to their undersides, and the undersides of the plate-shaped chain members and the guide shoes slide at high speeds of, for example, about 2 m/s, over correspondingly shaped guide rails, some of which may be curved. The relatively heavy weight of the metallic flat-top chains and their considerable loading by the material to be transported requires a correspondingly high-powered drive for such a chain conveyor and is associated with considerable wear of the chain members and guide rails. The lower the dimensional accuracy of the chain and the rougher the surface of the chain members the greater is the wear.

The steel heat-treated according to the process of the invention is generally characterised by about 50% higher yield strength, about 10% higher hardness, high toughness and uniformity, excellent cold-workability, improved surface quality, greater fatigue resistance, good weldability and longer life. Using the material for the manufacture of flat-top chains leads to less noise, lower wear, and reduced maintenance costs. Furthermore the greater dimensional accuracy of the chain members reduces the danger of tipping of the goods being transported, in particular when transporting bottles.

BRIEF DESCRIPTION OF THE DRAWINGS

An example of a flat-top or roller chain conveyor that may advantageously be made of steel according to the invention will now be described with reference to the drawings, in which.

DETAILED DESCRIPTION OF A PREFERRED EMBODIMENT OF THE INVENTION

Figure 1:
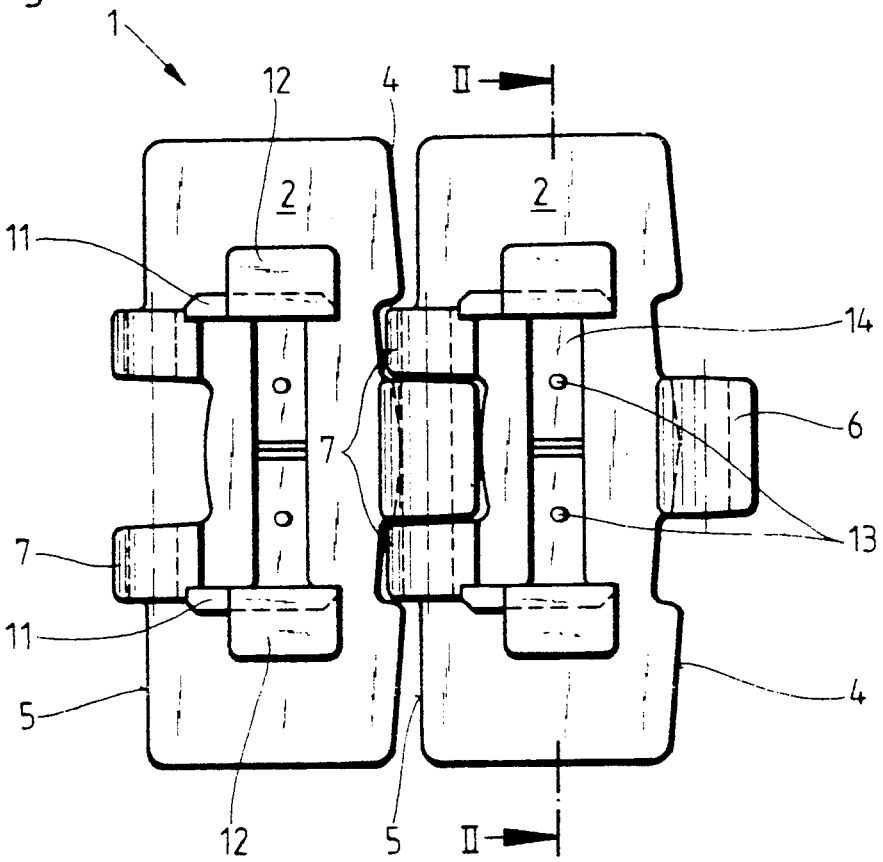
FIG. 1 shows a view from below of two chain members joined together.

A plate conveyor comprising a flat-top chain 1 is used, for example, to convey bottles and containers in industrial and packaging plants. A conveyor of this kind comprises chain members 2 arranged one behind the other which have a flat carrying surface 3 for the goods to be transported. The chain members 2 comprise a flat middle section of which the rear side edge 4 has a central hinge eye 6 and the opposed front side edge 5 has two hinge eyes 7 spaced apart. The central hinge eye 6 engages in the space between the hinge eyes 7 of the neighbouring plate member and is connected pivotably thereto by a hinge pin (not shown). The central hinge eyes 6 are shaped so that the individual chain members 2 can pivot laterally.

Figure 2:
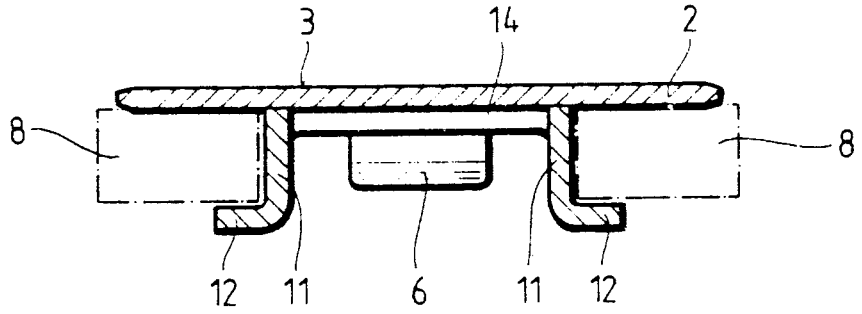
FIG. 2 shows a section along the line II—II shown in FIG. 1 with plate members folded into the plane of the drawing.

In the case of curved belt conveyors the flat-top chain is guided in a stationary guide track which comprises two opposed guide rails 8 and holds the flat-top chain in a horizontal plane and guides it into the curves. As shown in FIG. 2, each chain member has substantially vertical, downwardly extending guide surfaces 11 with guide lugs 12 bent outwardly at right angles to engage under the guide rails 8 for lateral and horizontal guidance on the guide rails 8.

Insofar as the guide surfaces 10, 11 are not made directly from a sheet integral with the plate member 2 but, as shown, are welded at the bottom to the chain member 2 by means of spot welds 13 and are connected to one another by a connecting rib 14, the plate members 2 can be provided with prefabricated, C-shaped guide shoes. The guide shoes then each consist of two guide surfaces 10 and 11 connected to one another by a connecting rib 14 which is welded by at least one spot weld 13 to the underside of the chain member, the guide surfaces 10, 11 already being welded off-centre to the connecting rib 20.

As can be seen from the diagrammatic drawing, for chain members good cold formability, weldability, hardness and resistance to wear are of particular importance, since the hinge eyes 6, 7 are bent from the lugs of a stamped flat blank of the material used. When conventional materials are used they tend to spring back, which is associated at least with large tolerances that lead to increased wear, if not to rejects. Furthermore welding-on the guide shoes 11, 12, 20 requires a material that can be welded without substantial embrittlement and without loss of corrosion-resistance in the heat-affected zone.

What is claimed is:

1. A process for heat treatment of a stainless, ferritic chromium hot-rolled steel comprising:

0.03 to 0.07% carbon
not more than 1% silicon
not more than 1% manganese
13 to 18% chromium
not more than 2% nickel
balance iron and impurities arising from melting, consisting of the steps:
solution-annealing said hot-rolled steel and then quenching same to form a ferritic-martensitic microstructure.

2. A process according to claim 1, wherein the chromium content of the steel is about 16%.

3. A process according to claim 1, wherein the annealing temperature is about 1050° C.

4. A process according to claim 1, wherein the steel contains one or more of the following:

not more than 0.06% carbon
at least 1% nickel
not more than 0.035% phosphorus
not more than 0.025% sulphur
0.02 to 0.04% nitrogen
and at least 0.025% carbon plus nitrogen.

5. A process for heat treatment of a stainless, ferritic chromium hot-rolled steel sheet or strip comprising:

0.03 to 0.07% carbon
not more than 1% silicon
not more than 1% manganese
13 to 18% chromium
not more than 2% nickel
balance iron and impurities arising from melting, consisting of the steps:
solution-annealing said hot-rolled steel,
thereafter quenching same to form a ferritic-martensitic microstructure,
thereafter cold-rolling the sheet or strip but only to a maximum thickness reduction of 10%.

* * * * *